United States Patent [19]

Helms et al.

[11] 3,971,468

[45] July 27, 1976

[54] CARTON PARTITION ARRANGEMENT

[75] Inventors: Charles R. Helms, Barto; William D. Patrick, Audubon, both of Pa.

[73] Assignee: Container Corporation of America, Chicago, Ill.

[22] Filed: July 11, 1975

[21] Appl. No.: 595,058

[52] U.S. Cl. ..... 206/193; 206/198; 229/28 BC; 229/52 BC

[51] Int. Cl.[2] ..... B65D 75/08; B65D 85/62

[58] Field of Search.... 206/198, 192, 193, 174–176, 206/180–191, 162–167, 141–143, 427, 428, 431, 433, 434; 229/27, 28 BC, 52 BC; 224/45 AB, 45 BA, 45 H

[56] References Cited

UNITED STATES PATENTS

| | | | |
|---|---|---|---|
| 1,799,657 | 4/1931 | Tinsley | 206/167 X |
| 2,163,290 | 6/1939 | Powell | 229/27 X |
| 2,222,211 | 11/1940 | Arneson | 229/52 BC X |
| 2,333,560 | 11/1943 | Gray | 229/52 BC X |
| 2,718,997 | 9/1955 | Shuxteau | 206/193 X |
| 2,850,223 | 9/1958 | Strauss | 229/52 BC X |
| 3,662,879 | 5/1972 | Helms | 206/433 |

*Primary Examiner*—Stephen P. Garbe
*Attorney, Agent, or Firm*—Carpenter & Ostis

[57] ABSTRACT

A folding carton for packaging a plurality of articles arranged in one or more rows having one or more transverse partition elements hingedly attached to both a horizontal and vertical wall of the carton by a gusset member.

6 Claims, 12 Drawing Figures

CARTON PARTITION ARRANGEMENT

SUMMARY OF THE INVENTION

The invention relates to open-top or basket-style carrier cartons formed of paperboard, or the like, for packaging a plurality or articles such as glass bottles.

It is an object of the invention to provide a carrier carton having an improved and simplified partition arrangement for separating adjacent bottles from each other.

Another object of the invention is the provision of an integral partition arrangement which requires no separate material for the partition and which requires no gluing or other outside fastening means for maintaining the transverse partition elements in position prior to loading the carton with packaged articles.

A specific object of the invention is the provision in a carrier carton arrangement of one or more transverse partition members which are hingedly attached to a vertical wall of the carton and also attached to the bottom wall of the carton by means of a gusset element hingedly interconnected between the lower edge of the transverse partition element and the carton bottom wall.

Another specific object of the invention is to provide an offset arrangement for the integral transverse partition elements, which is particularly suitable for the packaging of articles such as bottles which are not cylindrical in contour but which have a limited area with the widest diameter wherein only a small portion of the article is in engagement with the longitudinal and transverse partition elements and at the same vertical location.

THE DRAWINGS

Figure 2:
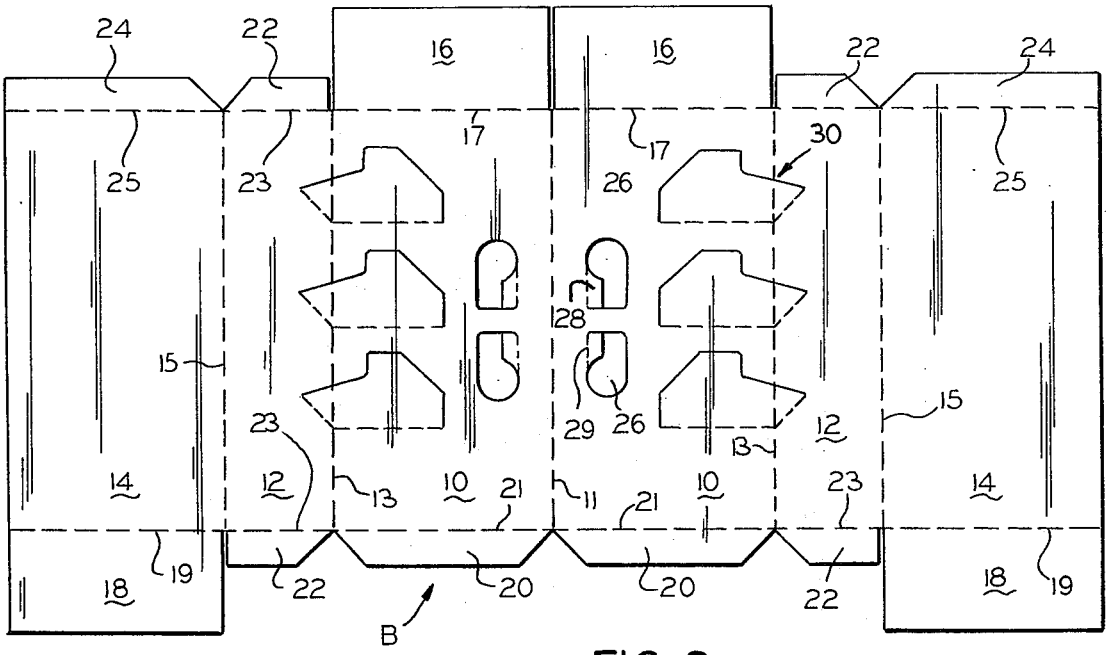
FIG. 2 is a plan view of a paperboard blank from which the carton illustrated in FIG. 1 may be formed.
Figure 1:
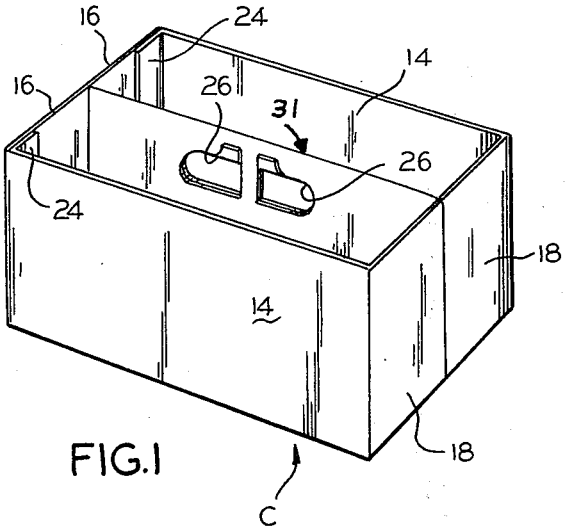
FIG. 1 is a perspective view of a paperboard carrier carton embodying features of the invention.
Figure 3:
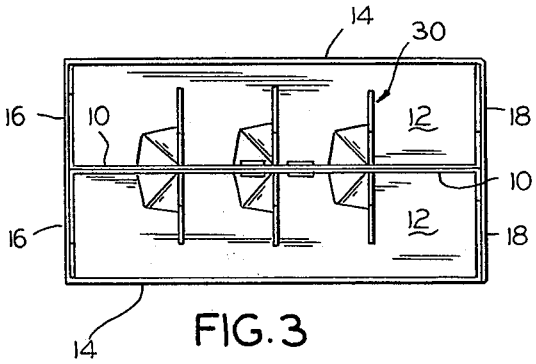
FIG. 3 is a top plan view of the structure illustrated in FIG. 1.
Figure 7:
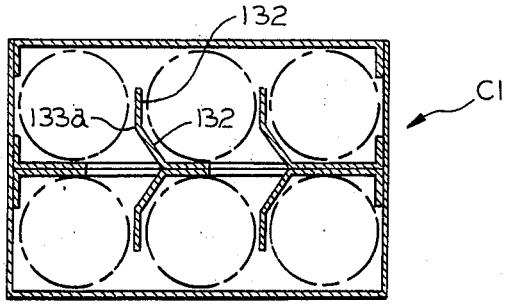
Figure 9:
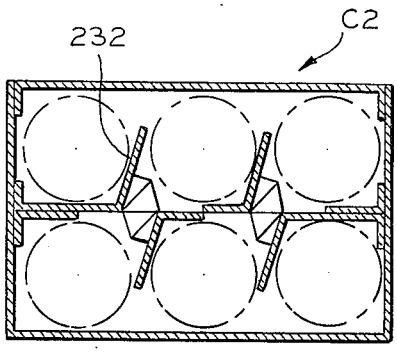
Figure 10:
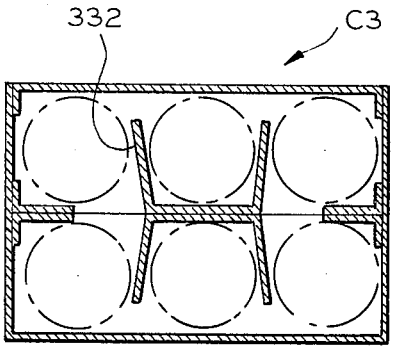
Figure 12:
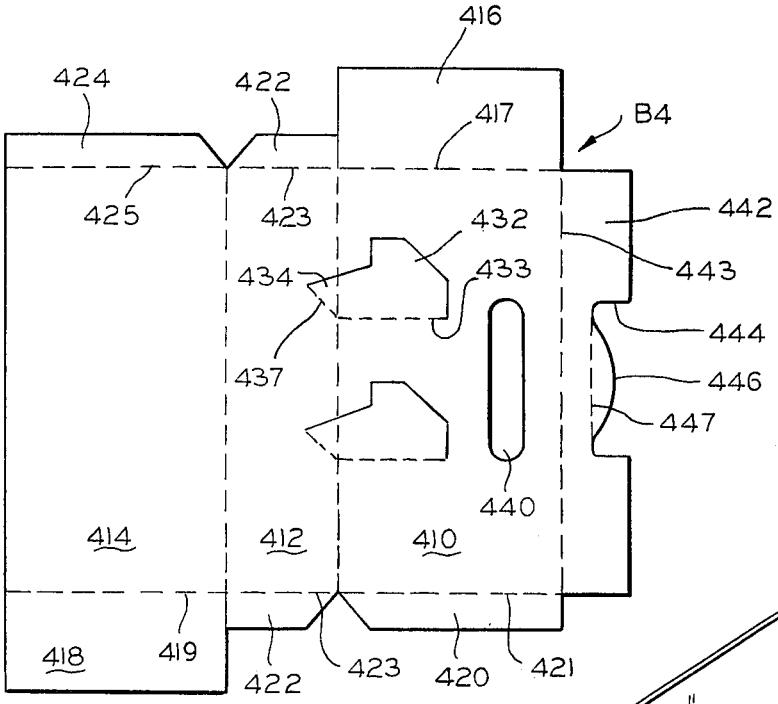
Figure 11:
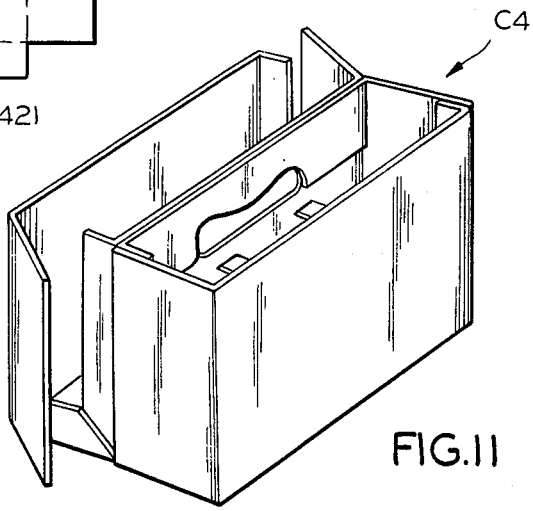

FIGS. 9 and 10 are views similar to that of FIG. 7, but illustrate modified forms of the off-set partition arrangement; and FIGS. 11 and 12 are views similar to those of FIGS. 1 and 2, but illustrate another modification of the invention.

It will be understood that for purposes of clarity certain elements have been intentionally omitted from certain views where they are believed to be illustrated to better advantage in other views.

Referring now to the drawings for a better understanding of the invention, it will be seen that the novel carrier carton indicated generally at C in FIG. 1 of the drawing may be formed from a unitary blank B of foldable paperboard illustrated in FIG. 2.

As best seen in FIG. 2, it will be seen that the blank B of paperboard is generally rectangular in construction and is cut and scored to provide a plurality of panels and flaps which may be folded and secured together in order to form the carrier carton C which includes a novel partition arrangement hereinafter described in detail in the Specification.

It will be seen that the central or main portion of the blank B of paperboard includes a pair of center panels 10 having adjacent edges hingedly attached to each other along a score line 11.

Outboardly of center panels 10 are a pair of bottom wall panels 12 which are hingedly attached to the outer edges of panels 10 along a score line 13. Again, outboardly of bottom wall panels 12 are a pair of side wall panels 14 which are hingedly attached to the outboard edges of bottom wall panels 12 along score lines 15.

First and second pairs of end walls 16 and 18 are hingedly attached to end edges of center panels 10 and side wall panels 14 along hinge lines 17 and 19, respectively. It will be noted that end wall panels 16 are attached to one end of the blank center wall panels, whereas end wall panels 18 are attached to the opposite ends of the side wall panels.

Hingedly attached on score lines 21 to the opposite ends of the center panels from where the end wall panels 16 are attached are a pair of glue panels 20. Each bottom wall panel 12 has a pair of glue panels 22 hingedly attached to its opposite edges on score line 23. Each side wall panel 14 has hingedly attached on score line 26 a glue panel 24 which is located at the opposite end of the side wall panel from the end wall panel 18. Thus, it will be seen when the carton is erected that the center panels are each folded in 180° in back-to-back relation and the bottom wall panels and side wall panels are each folded 90° relative to each other, and the end wall panels and glue panels are also folded over and secured to each other in overlapping relationship to provide the erected structure illustrated in FIG. 1. The center panels serve not only as a longitudinal partition member, but also as a carton carrying means and therefore may be provided with a plurality of hand holes 26, each of which may be provided with a reinforcing tab 28 hingedly attached to the related center panel 10 on a score line 29 adjacent the hand hole.

Figure 4:
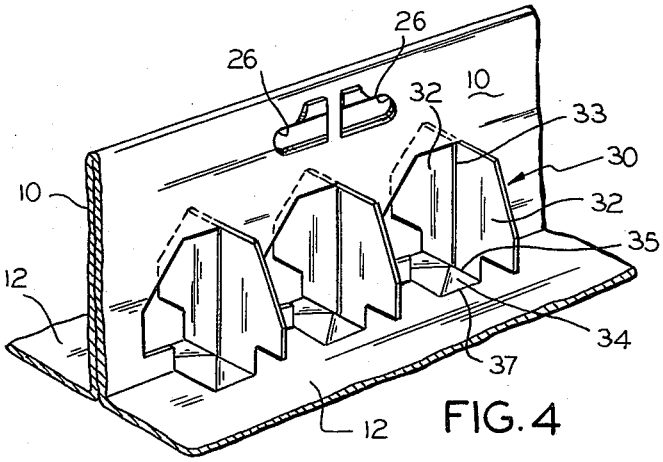
FIG. 4 is a perspective view of the structure illustrated in FIG. 1 with portions of the outer walls of the structure removed to illustrated the interior structure of the carton.

Turning now to FIGS. 2 and 4 primarily, it will be seen that the carton includes a novel transverse partition arrangement in which resides the essential features of the invention. It will be noted that there are located on opposite sides of the longitudinally extending partition member 31 a plurality of pairs of transverse partition members indicated generally at 30, each of which comprises a vertical partition element 32 and a horizontal partition element or gusset element 34. Vertical partition elements 32 are foldably attached to the center panels 10 on fold lines 33 which extend in a direction generally normal to the score lines connecting the center panels to the bottom wall panels. Horizontal gusset or retaining elements 34 are preferably triangular in shape and have one side edge foldably connected along fold lines 35 to the lower edges of the related vertical partition elements 32 and have other edges foldably connected on fold lines 37 to the related bottom wall panels 12.

Thus, it will be seen that when the carton is in the erected position, as best illustrated in FIG. 4, the transverse partition members 30 are maintained in the proper, separated, transversed position by means of the gusset elements 34 which rigidly hold the vertical elements 32 in position without the necessity of any glue flaps, straps, panels, or other securing or maintaining means.

Referring now to FIGS. 5 through 8, it will be seen that a slightly modified form of the invention is shown. Portions of the structure which correspond to portions of the structure in the previously described embodiment have been identified by similar numerals and need not be described in detail.

Figure 6:
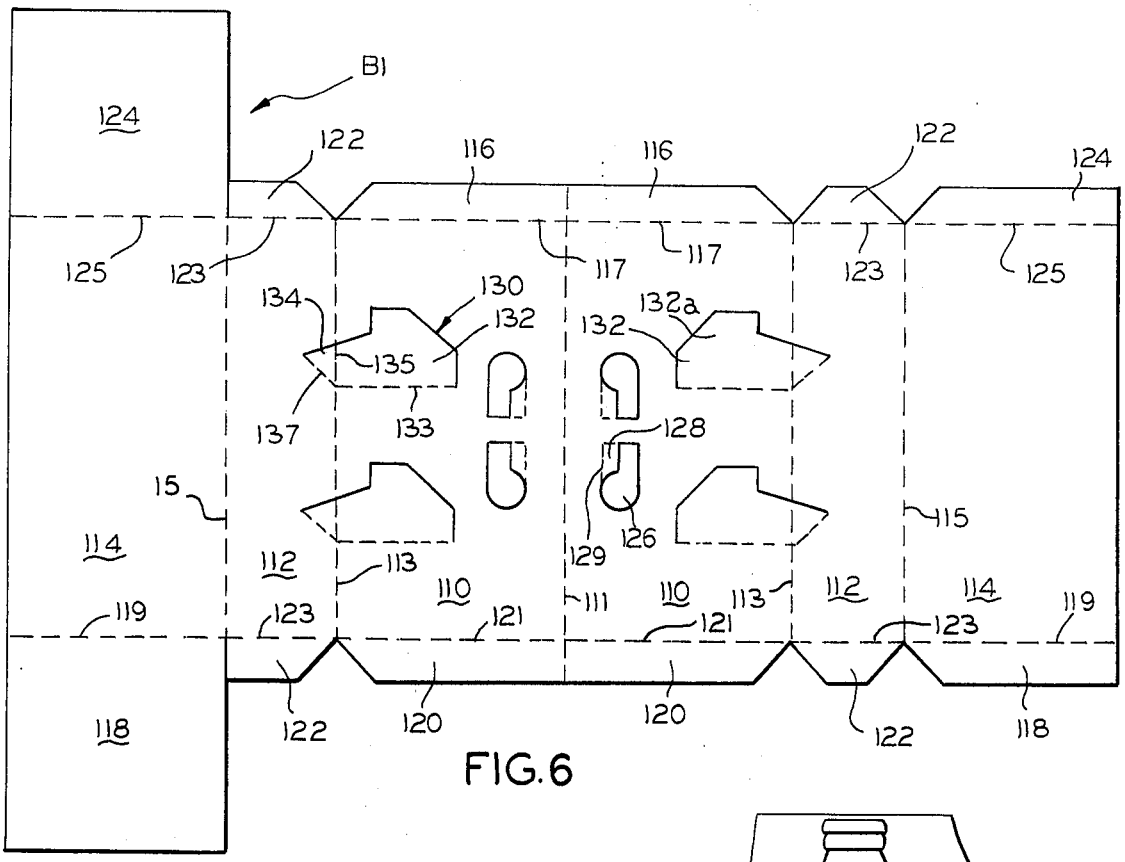
FIGS. 5–7 are views similar to those of FIGS. 1–3, respectively, but illustrate a modified form of the invention.
Figure 5:
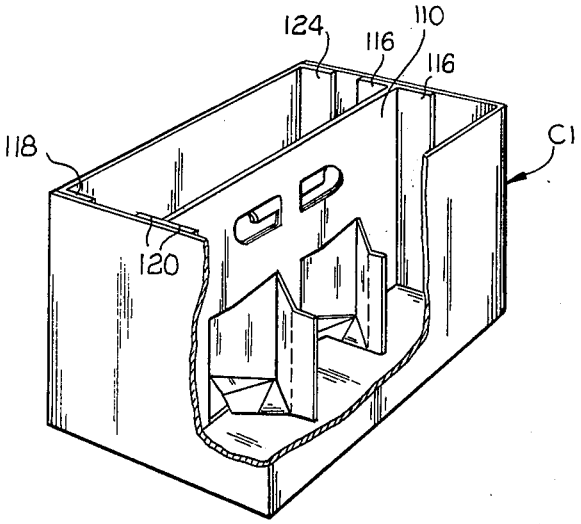

It will be seen that the blank B1 illustrated in FIG. 6, from which the carton illustrated in FIG. 5 may be formed, is similar to blank B illustrated in FIG. 2 except that the panels 124 ad 118 which are hinged to one of the side walls 114 are large enough to extend entirely across the opposite ends of the carton; whereas, the panels 124 and 118 hinged to the opposite side wall 114 are relatively narrow. When the carton is erected, the narrow panels 124 and 118 are glued to the inside surface of the wider panels 124 and 118, respectively, as best seen in FIG. 5.

Also, it will be noted that the transverse partition members indicated generally at 130, although similar to the transverse partition members of the previously described embodiments have two distinct features.

Figure 8:
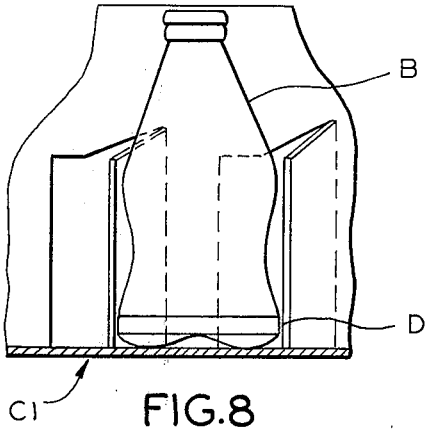
FIG. 8 is a fragmentary side elevation of the structure illustrated in FIG. 5, but with portions of the structure removed to illustrate the application of the off-set partitions to the packaged bottles.

First, the transverse partitions 130 are hinged to the longitudinal partition 110 at locations which are offset from the transverse vertical plane which passes between the bottles B being separated by the partition. The purpose for this is best illustrated in FIGS. 7 and 8, where it will be seen that the packaged article is a bottle which does not have a cylindrical configuration, but instead has an irregular configuration, wherein only a small vertical section of the bottle has a maximum diameter D, and therefore, is the only portion of the bottle which makes contact with the outer walls of the carton and the longitudinal and transverse partitions. Because there is only a limited area wherein the bottle contacts the partition, it has been found that by offsetting the transverse partitions, which are formed from material cut from the longitudinal partition, such material can be taken from the longitudinal partition at a location between points of tangency of the bottle to the longitudinal partition to prevent contact between adjacent bottles on opposite sides of the longitudinal partition.

Second, in order to have the end portion 132*a* of the transverse partition 132 disposed between the points of tangency of adjacent bottles on the same side of the longitudinal partition, it is necessary that it be bent or folded at an angle with respect to the remainder of the partition 132. If desired, although not necessary, an additional fold line 133*a* may be formed in the partition 132.

FIGS. 9 and 10 illustrate modified forms of the transverse partition arrangement similar to that illustrated in FIG. 7. In each case, the transverse partitions are offset to insure that material is left in the longitudinal partition in the areas where it is in contact with the widest portion of each packaged bottle.

Now referring to FIGS. 11 and 12, it will be seen that yet another form of the invention is shown. In this embodiment, the carton C4 is formed from a pair of separate but identical blanks B4 illustrated in FIG. 12. Each of the blanks B4 is similar to one half of the blank B illustrated in FIG. 2, the only difference being the addition of a one-piece hand hole 440 cut in center panel 410 and the provision of an additional flap 442 which is hingedly attached to the upper edge of center panel 410 on fold line 443. Panel 442 is provided with a central cut-out portion 444 into which extends a small tab 446 hingedly attached to the panel along fold line 447. In the formation of the carton C4 corresponding center panels 410 are secured to each other in back-to-back relationship with the auxiliary panels 442 reverse folded 180° to form a reinforced handle arrangement.

Thus, it will be understood that all the embodiments of the invention have the same inventive concept in common, which is the provision of a transverse partition cut from portions of the vertical and horizontal walls of the carton and hingedly attached thereto by gusset means so as to provide an integral transverse partition arrangement which requires no glue, stapling, or outside fastening means. The transverse partition elements may be off-set or not, depending upon the particular configuration of the articles to be packaged therein.

We claim:

1. In a basket-style carrier carton, formed of foldable paperboard, for holding a plurality of packaged articles arranged in two side-by-side rows, the combination of:

a. opposed pairs of side and end walls and a bottom wall hingedly interconnected to form a box-like structure open at the top;

b. a longitudinally extending center partition member, for separating said rows of articles from each other, hingedly attached to said end walls and said bottom wall;

c. a plurality of transversely extending partition members, for separating the articles of each row from each other, each comprising:

i. a vertical divider element having one side edge hingedly attached to said center partition member and extending in a direction normal to said center partition member;

ii. a horizontal gusset element having one edge hingedly attached to said bottom wall and having another edge hingedly attached to a lower edge of said vertical divider element and being operable to maintain said vertical divider element in position when the carton is in erected condition.

2. In a carton formed of foldable paperboard, for holding a plurality of packaged articles arranged in a row, the combination of:

a. opposed pairs of longitudinal and transverse walls and a bottom wall hingedly interconnected to form a box-like structure;

b. at least one transversely extending partition member, for separating articles of said row from each other, comprising:

i. a vertical divider element, having one side edge hingedly attached to one of said longitudinal walls and extending in a direction normal thereto;

ii. a horizontal gusset element having one edge hingedly attached to said bottom wall and having another edge hingedly attached to a lower edge of said vertical divider element and being operable to maintain said vertical divider element in position when the carton is in erected condition.

3. A carton according to claim 1, wherein the vertical divider element and the horizontal gusset element of said transversely extending partition member are formed from material cut from one of the longitudinal walls and the bottom wall, respectively.

4. A carton according to claim 3, wherein the material to form said vertical divider wall is cut from said one longitudinal wall at a location on said longitudinal wall which is spaced from the point of tangency where a packaged article would contact said one longitudinal wall.

5. A carton according to claim 2, wherein said carton is formed from a one-piece blank of foldable paperboard.

6. A carton according to claim 2, wherein said carton is formed from a pair of similar blanks of foldable paperboard which are secured to each other in back-to-back relation to form said carton.

* * * * *